US005934473A

United States Patent [19]

Belshé

[11] Patent Number: 5,934,473

[45] Date of Patent: Aug. 10, 1999

[54] METHOD FOR PACKAGING ARTICLE AND CRADLE INSERT

[75] Inventor: Thomas B. Belshé, South San Francisco, Calif.

[73] Assignee: International Paper Co., Purchase, N.Y.

[21] Appl. No.: 08/880,278

[22] Filed: Jun. 23, 1997

Related U.S. Application Data

[63] Continuation-in-part of application No. 08/662,872, Jun. 12, 1996, abandoned.

[51] Int. Cl.[6] ..... B65D 81/02

[52] U.S. Cl. ..... 206/583; 206/320; 206/576; 206/594; 53/449

[58] Field of Search ..... 206/32, 497, 576, 206/591, 592, 594, 521, 523, 583; 53/441, 449, 450, 461

[56] References Cited

U.S. PATENT DOCUMENTS

| | | | |
|---|---|---|---|
| 2,031,381 | 2/1936 | McCallum . | |
| 3,087,610 | 4/1963 | Kirkpatrick | 206/497 |
| 3,092,246 | 6/1963 | Harrison et al. | 206/497 |
| 3,215,266 | 11/1965 | Dreyfus | 206/497 |
| 3,513,620 | 5/1970 | Billingsley et al. . | |
| 3,562,999 | 2/1971 | Barbedienne . | |
| 3,675,765 | 7/1972 | Melsek . | |
| 3,878,943 | 4/1975 | Ryan et al. . | |
| 3,966,046 | 6/1976 | Deutschlander . | |
| 4,119,202 | 10/1978 | Roth . | |
| 4,247,663 | 1/1981 | Yoshiga et al. | 206/497 |
| 4,254,869 | 3/1981 | Heier . | |
| 4,260,071 | 4/1981 | Bamburg et al. . | |
| 4,306,653 | 12/1981 | Fales . | |
| 4,307,804 | 12/1981 | Benham . | |
| 4,398,212 | 8/1983 | Serry et al. . | |
| 4,757,900 | 7/1988 | Misset et al. . | |
| 4,877,137 | 10/1989 | Govang et al. . | |
| 4,919,270 | 4/1990 | Govang et al. . | |
| 4,941,572 | 7/1990 | Harris . | |
| 5,086,925 | 2/1992 | Coalier et al. . | |
| 5,111,931 | 5/1992 | Gombos et al. | 206/497 |
| 5,128,157 | 7/1992 | Ruiz . | |
| 5,144,897 | 9/1992 | Avery . | |
| 5,323,896 | 6/1994 | Jones . | |
| 5,385,232 | 1/1995 | Foos et al. . | |
| 5,417,034 | 5/1995 | Gabler et al. . | |
| 5,678,695 | 10/1997 | Ridgeway et al. | 206/320 |

FOREIGN PATENT DOCUMENTS

| | | |
|---|---|---|
| 691904 | 8/1964 | Canada . |
| 1049457 | 7/1975 | Canada . |
| 1582517 | 10/1969 | France . |
| 2306900 | 5/1976 | France . |
| 2291113 | 11/1976 | France . |
| 2059497 | 6/1972 | Germany . |
| 2922907 | 11/1980 | Germany . |
| 1156666 | 6/1989 | Japan . |

*Primary Examiner*—Paul T. Sewell
*Assistant Examiner*—Luan K. Bui
*Attorney, Agent, or Firm*—Thompson Hine & Flory

[57] ABSTRACT

A packaging assembly comprising a cradle or carton insert onto which an article is bound by stretch wrap film. The packaging assembly further comprises a container which receives the cradle. A method for packaging an article using the packaging assembly is also disclosed.

27 Claims, 4 Drawing Sheets

METHOD FOR PACKAGING ARTICLE AND CRADLE INSERT

This application is a continuation-in-part of U.S. application Ser. No. 08/662,872 filed Jun. 12, 1996, abandoned.

BACKGROUND OF THE INVENTION

The present invention relates to a method for packaging an article and, more particularly, to a cradle or carton insert upon which an article can be secured using a stretch wrap material prior to inserting the cradle into a container, such as a shipping container.

Conventionally, articles packaged within containers have been secured and protected against damage during shipping by incorporating larger volumes of packing materials, such as styrofoam elements or other cushioning or insulative materials, around the articles within the container. These packing materials are an added expense and are environmentally undesirable because many of the traditional packing materials are not easily and readily recyclable. Therefore, there is a need for a packaging system that secures and protects articles within a container from damage, that does not utilize the traditional packing materials, and is relatively inexpensive and convenient to use compared to the traditional packaging systems.

Furthermore, traditionally articles are often packaged within containers as separate units, i.e., not secured or bound to a removable cradle or carton insert. In order to remove the article from the shipping container, one had to grasp the article and remove the article from the shipping container, which depending upon the article's size, shape and weight could be a difficult task.

The use of heat shrinkable film or stretch wrap film in packaging systems is known in the art. For example, it is known to shrink wrap or stretch wrap containers as an additional preventative measure to ensure that the container does not accidentally open during transport.

Furthermore, it is known in the art to assemble stock keeping units (SKUs) by binding a collection of products or containers together on shipping pallet using a stretch wrap film. Usually, the products or containers are resting on a pallet and the shrink wrap film or stretch wrap film secures the products or containers to each other and to the pallet itself.

U.S. Pat. No. 4,941,572 to Harris teaches a method and package for fresh cut flower arrangements and plants whereby the flower container is secured to a carton insert which can be removed after opening the shipping container. The carton insert does not have handles for the person to grasp when removing the carton insert from the shipping container, nor is the article, a flower container, bound to the carton insert by wrapping film.

Japanese Patent Application No. 1-156665 to Minoo et al. teaches a hermetic sealing method for specimen vessels comprising a shipping container and inner package inserts which consist of two sheets of shrinkable film into which specimen vessels are placed and sealed.

U.S. Pat. No. 5,323,896 to Jones teaches an article packaging kit, system and method that utilizes a plastic sleeve or tube to secure an article to a body after sliding the tube over the body, inserting the article, and folding the sides of the body upward. The plastic sleeve or tube barely stretches on the order of 10% elasticity.

Accordingly, there is a need for a new method for packaging articles within shipping containers that is relatively inexpensive, more environmentally conscious, facilitates easier removal of the articles from the containers, and provides cushioning elements that replace foam as a cushioning alternative.

SUMMARY OF THE INVENTION

The present invention is a method for packaging an article and the packaging assembly produced by the method. The packaging assembly of the present invention protects the article from damage during shipping without the inconvenience of using traditional packing materials and facilitates relatively easy removal of the article from the shipping container.

It has been found that wrapping films such as stretch wrap film secure an article onto a cradle or carton insert contained within a shipping container. By binding the article to the insert in this manner, the article is protected from damage during shipping and the insert facilitates removal of the article from the shipping container.

In accordance with one embodiment of the present invention, a method for packaging an article comprises:

providing a cradle having a floor panel and a first pair of parallel opposed side panels extending from the floor panel, the floor panel including an interior surface and an exterior surface;

placing an article on the interior surface of the floor panel between the first opposed side panels;

binding the article to the cradle by wrapping a film material about the article and the cradle so as to bind the article to the cradle; and;

inserting the cradle into a container.

In a second embodiment of the present invention, a packaging assembly comprises:

a cradle having a floor panel and a first pair of parallel side panels extending from the floor panel, the floor panel having an interior surface and an exterior surface; and an article being bound to the interior surface of the floor panel between the first pair of side panels of the cradle by a wrapping film.

In a third embodiment, the packaging assembly above further comprises a container which receives the cradle.

Accordingly, it is an object of the present invention to provide an improved method for packaging articles to prevent damage to the articles from occurring during shipping and to facilitate removal of the article from the container. This new method provides a relatively inexpensive and environmentally desirable method of securing and protecting the articles.

Other objects and advantages of the present invention will be apparent from the following description and the appended claims.

DETAILED DESCRIPTION

The packaging assembly and method of the present invention utilize wrapping films such as stretch wrap film to bind an article to a cradle or carton insert and are useful in packaging articles in shipping containers to prevent damage to the articles during shipping. The assembly and method of the present invention can be used to package a wide variety of articles but it is particularly useful in packaging appliances such as televisions, electronic equipment, computers, and the like.

Figure 1:
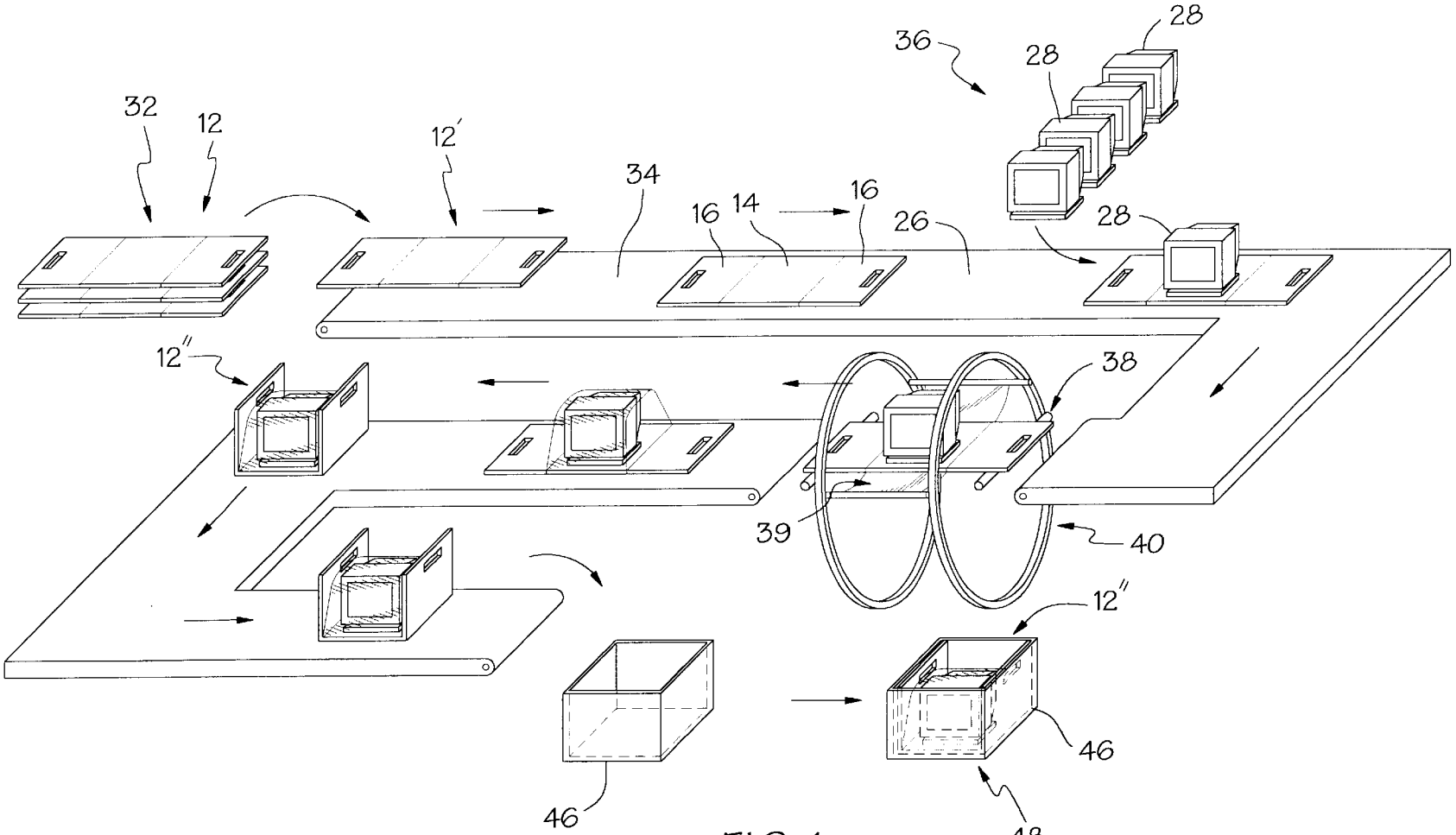
FIG. 1 is a schematic diagram of a preferred embodiment of the present invention.
Figure 2:
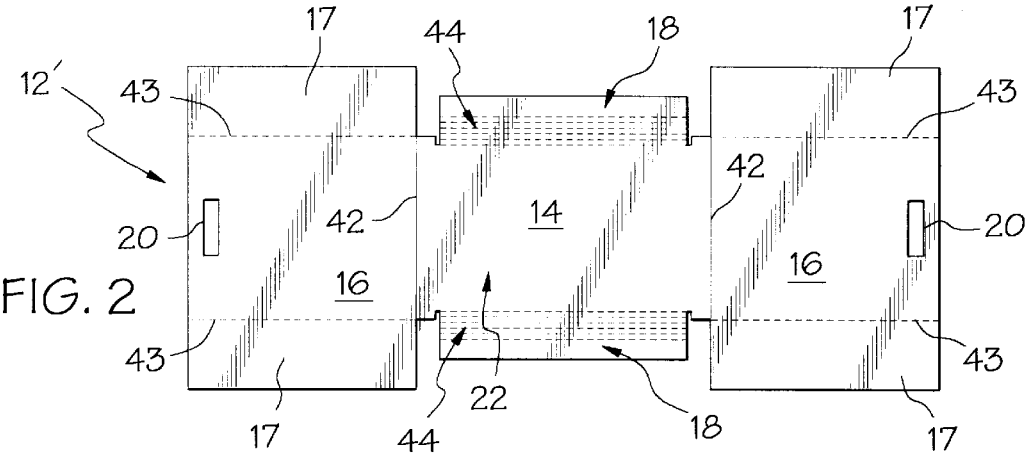
FIG. 2 is a top view of an alternate embodiment of a cradle in accordance with the present invention.
Figure 3:
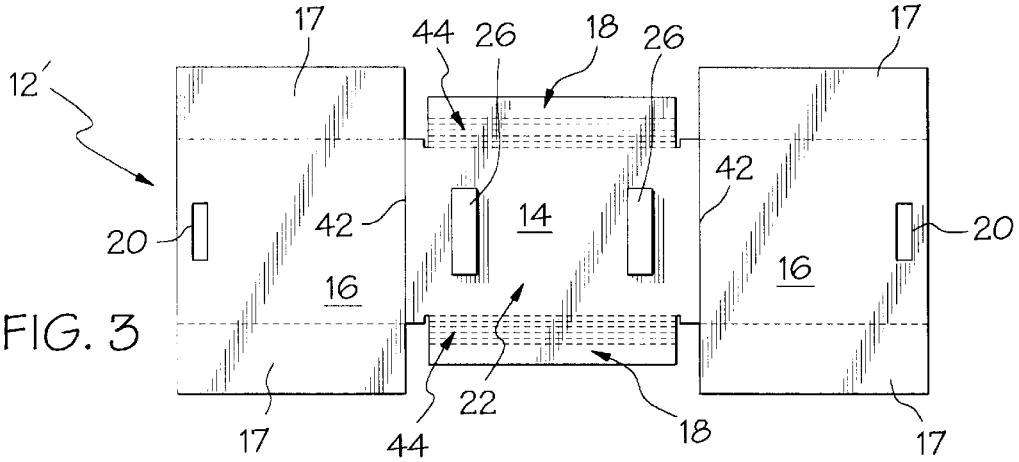
FIG. 3 is a top view of a preferred embodiment of a cradle in accordance with the present invention.

A schematic diagram of one embodiment of the present invention, a method for packaging an article is illustrated in FIG. 1. FIG. 1 represents a conveyor belt or assembly line production in which the cradle 12 of the present invention initially is in a flat unfolded state, generally designated 12'. The flat cradle 12' includes a floor panel 14 and a first pair of parallel side panels (shown in the flat position), generally designated 16, extending from the floor panel 14. As illustrated in FIGS. 2 and 3, preferably, the side panels 16 include a pair of parallel subpanels (shown in the flat position), generally designated 17, which extend from opposite side edges of the side panels 16. It is desirable that the side panels 16 also include handles 20. As shown in FIGS. 2 and 3, preferably, the floor panel 14 further includes a second pair of parallel side panels (shown in the flat position), generally designated 18, which extend from opposite side edges of the floor panel 14.

The floor panel 14 has an interior surface 22 and an exterior surface 24. Preferably, the interior surface 22 includes packaging support means, generally designated 26, which are bonded, laminated or attached to the interior surface 22, upon which an article 28 rests, as shown in FIG. 3. Preferably, the packaging support means 26 is a cushioning means such as rubber, foam, plastic, paper (i.e. honeycomb or recycled corrugated paper material) or combinations thereof.

The cradle 12 can be formed from a conventional grade of container board such as 200 pound, 275 pound, singlewall or doublewall corrugated material. In some cases it may be desirable to bond styrofoam blocks or some other resilient cushioning material, as described above, to the cradle 12 as packaging support means 26 or to design the cradle 12 with cut outs or fold outs to accommodate the outer structure of the packaged article 28.

As illustrated in FIG. 1, the flat cradle 12' is transferred from a stack generally designated 32, to a conveyor belt, generally designated 34, by any manner known in the art.

Figure 4:
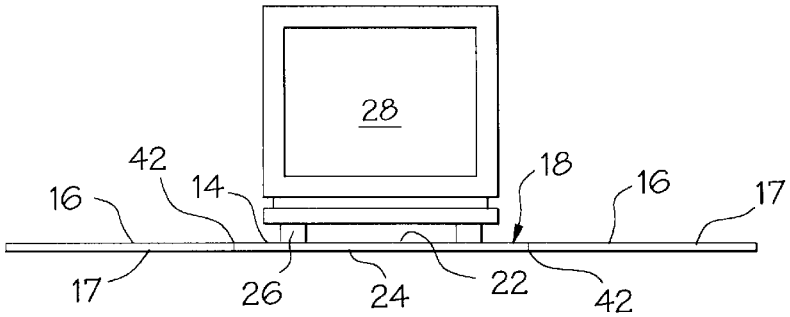
FIG. 4 is a side view of FIG. 3 with an article resting on the cradle in accordance with the present invention.

At station 36, an article 28, such as a television, electronic equipment, computer, and the like, is then placed upon the interior surface 22 of the floor panel 14, preferably the article 28 is placed upon the packaging support means 26 bonded to the interior surface 22, by any manner known in the art, as shown in FIG. 4. For example, the article 28 may be fed to station 36 on a conveyor which advances the article 28 to a point at which it is deposited on the flat cradle 12' by a robotic arm, an elevator or other means known in the art.

Figure 5:
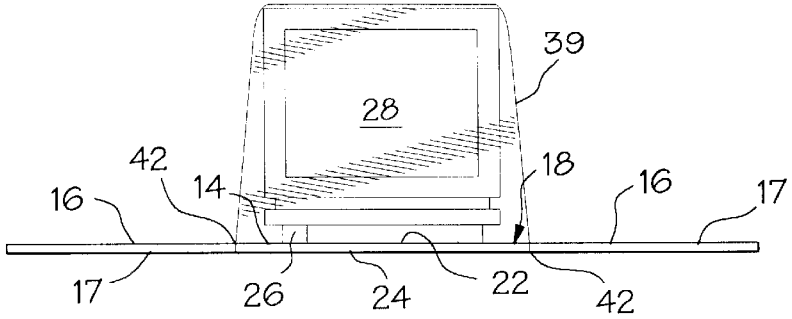
FIG. 5 is a side view of FIG. 4 with stretch wrap around the cradle and article in accordance with the present invention.

After the article 28 is placed upon the packaging support means 26 of the flat cradle 12', the article 28 and flat cradle 12' are advanced to a station 38 at which wrapping film, preferably stretch wrap film, generally designated 39, is wrapped around the bottom of the flat cradle 12' and about the sides and top of the article 28 to bind and secure the article 28 to the flat cradle 12', as shown in FIG. 5. Preferably, the wrapping film 39 extends around the article 28 and the cradle 12' by wrapping the wrapping film 39 about an axis which is parallel to the floor panel 14 and perpendicular to the first pair of side panels 16 after folding upwardly to form the folded cradle 12" (see FIGS. 6 and 7). It is desirable to wrap the wrapping film around and about the cradle and article two (2) or more times, more desirably three (3) or more times. This wrapping operation at station 38 can be performed by using stretch wrap film equipment, generally designated 40, which is known in the art. One example of stretch wrapping equipment is described in U.S. Pat. No. 5,463,842 to Lancaster. Those skilled in the art will appreciate that other wrapping methods and/or equipment may be used. One commercially available wrapping machine that can be used herein is a Lan-ringer wrapping machine manufactured by Lantech™, Inc.

The stretch wrap film used in the present invention is preferably a cast extruded multilayered stretch polyethylene film. The elasticity of the stretch wrap film is typically up to 300%, for example, a film with a length of 1 inch stretches to a length to a maximum length of about 3 inches. The stretch wrap film used in the present invention preferably has an elasticity of about 100 to 250%, more preferably 150 to 250%.

The stretch wrap film also must have significant longterm elastic memory such that it returns or attempts to return to its original state after being stretched around the packaged article thereby binding it to the cradle. Unlike heat shrinkable films that lose their elastic memory upon being heated, the stretch wrap film used in the present invention retains its memory.

Figure 6:
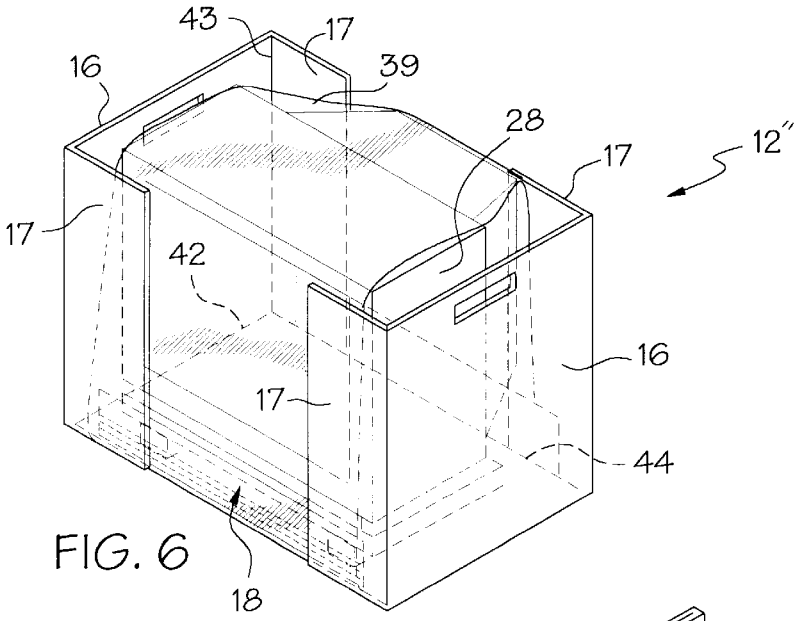
FIG. 6 is a perspective view of an alternate embodiment of a cradle having an article stretch wrapped to the cradle in accordance with the present invention.
Figure 7:
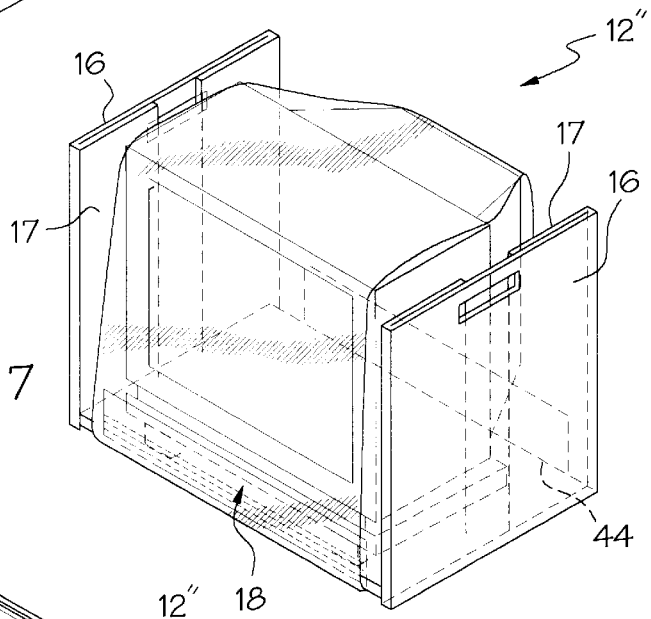
FIG. 7 is a perspective view of an alternate embodiment of a cradle having an article stretch wrapped to the cradle in accordance with the present invention.

Following the wrapping operation at station 38, the first pair of side panels 16 of the flat cradle 12' are folded up along fold lines 42 and the subpanels 17 are folded along fold lines 43 such that the subpanels 17 and the side panels 16 form substantially right angles as shown in FIG. 6 or are substantially folded together as shown in FIG. 7. The second pair of side panels 18 are folded along any one of various fold lines, generally designated 44, depending upon the size of the article 28 such that the article 28 is substantially disposed by the first and second pair of side panels, 16 and 18, respectively, and the subpanels 17, resulting in a folded cradle 12" as shown in FIGS. 6 and 7. Preferably, the second pair of side panels 18 are substantially equal to or less than the height of the article 28 such that the stretch wrap film 39 fits tightly around the second pair of side panels 18 and the article 28, preventing the article 28 from moving about during shipping. The fold lines 44 of side panels 18 allow the side panels 18 to be folded up along the sides of the article 28 at different heights. All of these folding steps can be performed in any manner known in the art.

Figure 8:
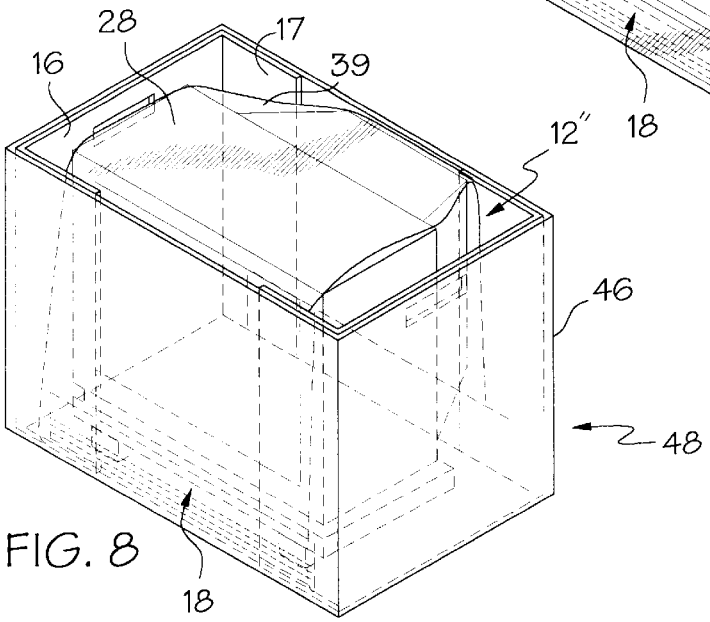
FIG. 8 is a perspective view of a packaging assembly in accordance with the present invention.

The folded cradle 12" is then lifted off the conveyor belt 34 and inserted into a shipping container 46, by any manner known in the art, to result in the packaging assembly, generally designated 48, as shown in FIG. 8. Preferably, the folded cradle 12" is lifted off the conveyor belt 34 by grasping the handles 20.

As shown in FIG. 8, the packaging assembly 48 comprises the folded cradle 12" having the article 28 bound to it by stretch wrap 39 and further comprises the shipping container 46 which receives the folded cradle 12". Preferably, the shipping container 46 includes a bottom panel and four wall panels. More preferably, the shipping container 46 further includes a top panel hingedly connected to one of the wall panels or a lid (not shown).

Figure 9:
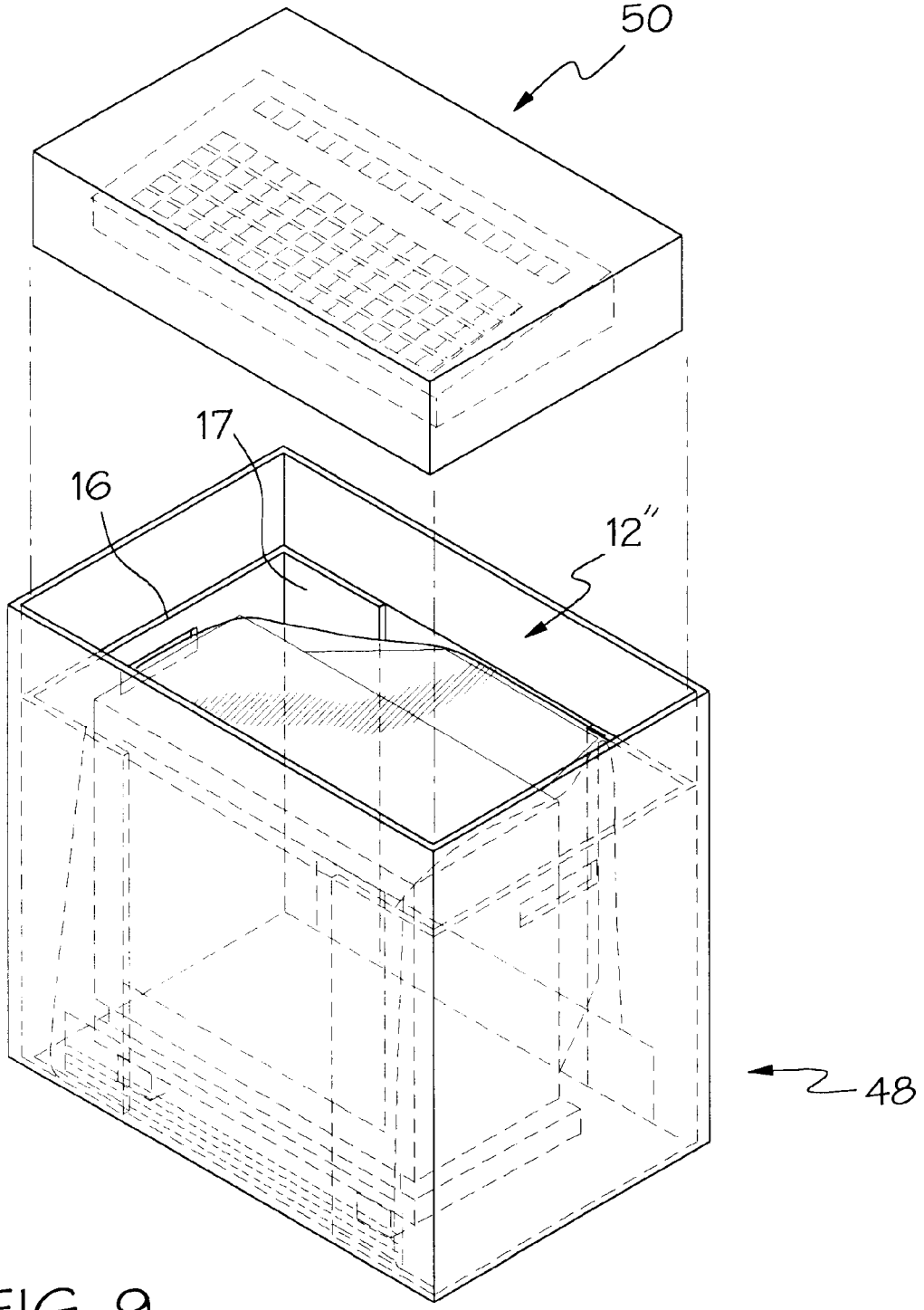
FIG. 9 is a partially exploded view of an alternate embodiment of a packaging assembly in accordance with the present invention.

Preferably, the sides 16 and subpanels 17 of the cradle 12 are substantially equal to the height of the walls of the shipping container 46 when the folded cradle 12" is incorporated into the shipping assembly 48 in order to prevent damage to the article 28, which can result from jarring, in the event the packaging assembly 48 is overturned. That is the cradle side panels 16 and subpanels 17 are long enough that the article 28 will be suspended above the top of the container if the container is inverted during shipping. Those skilled in the art will appreciate that the cradle walls may be substantially shorter than the container walls if the container is designed to have other articles boxed and packaged along with the folded cradle 12" having the article 28 bound to it during shipping. For example, it is not unusual for the keyboard to be boxed separately and stacked on top of the computer during shipment. In this case, the keyboard box, generally designated 50, may sit on the corners of the folded cradle 12" formed by the sides 16 and subpanels 17 and bridge the cradle sides 16 during shipment, as shown in FIG. 9. To provide space for the keyboard, the cradle sides 16 and subpanels 17 may be, for example, 3 inches shorter than the container walls. More than one cradle can be stacked within a shipping container, similar to the manner in which computers and computer keyboards are packaged, so long as the total height of the first pair of side panels 16, including the subpanels 17, of the folded stacked cradles is substantially equal to, but not greater than, the height of the walls of the shipping container. In other words, the combination of the cradle and keyboard box or other body must be received within the container for shipping. Those skilled in the art will appreciate that other modifications and combinations of cradles inserted within shipping containers would fall within the scope of the present invention.

Preferably, the cradle is made from a material selected from a group consisting of corrugated paper or wood, more preferably corrugated paper.

Preferably, the shipping container is made from a material selected from a group consisting of corrugated paper, more preferably corrugated paper.

In an alternate embodiment of the present invention, the folded cradle 12" further comprises a second pair of parallel side panels 48 extending from the floor panel 14, Having described the invention in detail and by reference to the drawings and the preferred embodiments it will be apparent to those skilled in the art that modifications and variations are possible without departing from the scope of the invention as defined in the following appended claims.

What is claimed is:

1. A packaging assembly comprising:

a cradle having a floor panel and a first pair of parallel side panels extending from the floor panel, the floor panel having an interior surface and an exterior surface;

an article positioned on the interior surface of the floor panel between the first pair of upwardly folded side panels of the cradle and a wrapping film capable of being stretched up to 300% extending around the article and the cradle and binding the article to the cradle and the wrapping film is wrapped around the article and the cradle at least two complete times about an axis which is parallel to said floor panel and perpendicular to said first pair of side panels.

2. The packaging assembly of claim 1 wherein the wrapping film is stretch wrap film having an elasticity of about 100 to 250%.

3. The packaging assembly of claim 1 wherein the interior surface of the floor panel includes a packaging support upon which the article rests.

4. The packaging assembly of claim 1 wherein the first pair of side panels includes handles.

5. The packaging assembly of claim 1 wherein the cradle further includes a second pair of parallel side panels.

6. The packaging assembly of claim 5 wherein the second pair of parallel side panels is capable of being folded upwardly to substantially enclose the article within the first and second pair of side panels.

7. The packaging assembly of claim 5 wherein the panels in the second pair of side panels are equal to or less than height of the article such that the wrapping film can firmly bind the article to the cradle.

8. The packaging assembly of claim 1 wherein the first pair of parallel side panels further include subpanels which extend from opposite side edges of the first pair of side panels.

9. The packaging assembly of claim 8 wherein the subpanels are capable of being folded along a fold line such that the subpanels and the first pair of side panels form an angle of about 90° or less.

10. The packaging assembly of claim 1 wherein the assembly further includes a container which receives the cradle.

11. The packaging assembly of claim 10 wherein the container includes a bottom panel having four wall panels extending therefrom.

12. The packaging assembly of claim 11 wherein the panels of the first pair of side panels of the cradle are sufficiently long that the article is suspended from the cradle if the container is inverted.

13. The packaging assembly of claim 11 wherein the panels of the first pair of side panels of the cradle are short enough that at least one other body can be inserted into the container such that a combination of the cradle and the other body is received within the container.

14. The packaging assembly of claim 1 wherein said film is wrapped two or more times about the article and the cradle.

15. A method for packaging an article comprising:

providing a cradle having a floor panel and a first pair of parallel side panels extending from the floor panel, the floor panel including an interior surface and an exterior surface;

placing an article on the interior surface of the floor panel between the first pair of side panels;

binding the article to the cradle by wrapping a wrapping film capable of being stretched up to 300% about the article and the cradle at least two complete times about an axis which is parallel to said floor panel and perpendicular to said first pair of side panels after said first pair of side panels are folded upwardly;

folding the first pair of parallel side panels upwardly such that an article is substantially disposed between the first pair of parallel side panels; and inserting the cradle into a container.

16. The method of claim 15 wherein the interior surface of the floor panel includes a packaging support upon which the article rests.

17. The method of claim 15 wherein the first pair of side panels includes handles such that the cradle can be easily inserted into or removed from the container.

18. The method of claim 15 wherein the wrapping film is stretch wrap film having an elasticity of about 100 to 250%.

19. The method of claim 15 wherein the first pair of parallel side panels further include subpanels which extend from opposite side edges of the first pair of side panels.

20. The method of claim 19 wherein the subpanels are capable of being folded along a fold line such that the subpanels and the first pair of side panels form an angle of about 90° or less.

21. The method of claim 15 wherein the cradle further includes a second pair of parallel side panels.

22. The method of claim 21 wherein the panels of the second pair of parallel side panels are capable of being folded upwardly to substantially enclose the article between the second pair of side panels.

23. The method of claim 21 wherein the panels of the second pair of side panels are substantially equal to or less than height of the article such that the wrapping film fits tightly around the second pair of side panels and the article.

24. The method of claim 15 wherein the container includes a bottom panel having four wall panels extending therefrom.

25. The method of claim 24 wherein the panels of the first pair of side panels of the cradle are sufficiently long that the article is suspended from the cradle if the container is inverted.

26. The method of claim 24 wherein the panels of the first pair of side panels of the cradle are short enough that at least one other body can be inserted into the container such that a combination of the cradle and the other body is received within the container.

27. The method of claim 16 wherein said step of binding includes wrapping the film two or more times about said axis.

* * * * *